United States Patent [19]

Wear et al.

[11] 4,356,774

[45] Nov. 2, 1982

[54] TRUCK BOLSTER FLANGE AND WEAR RING

[76] Inventors: Charles W. Wear, 124 Chippewa Cir.; Robert J. Carl, 334 Shamrock Rd., both of Gretna, Nebr. 68028

[21] Appl. No.: 122,574

[22] Filed: Feb. 19, 1980

[51] Int. Cl.[3] ..... B61F 5/16; F16C 17/10; F16C 41/00

[52] U.S. Cl. ..... 105/199 C; 105/189; 105/226; 308/137

[58] Field of Search ..... 105/199 C, 199 CB, 199 R, 105/189, 226; 308/137, 138, 225

[56] References Cited

U.S. PATENT DOCUMENTS

| | | | |
|---|---|---|---|
| Re. 28,279 | 12/1974 | Robertson | 105/199 C |
| 3,218,989 | 11/1965 | Kreiner et al. | 105/199 C X |
| 3,711,927 | 1/1973 | Davidson | 105/199 C X |
| 3,832,954 | 9/1974 | Amwake | 105/199 C |
| 4,040,362 | 8/1977 | Oppenheim et al. | 308/137 X |

*Primary Examiner*—Joseph F. Peters, Jr.
*Assistant Examiner*—Howard Beltran
*Attorney, Agent, or Firm*—Zarley, McKee, Thomte, Voorhees & Sease

[57] ABSTRACT

A truck bolster ring is described comprising an annular ring adapted to be secured to the truck bolster and having inner and outer diameters. A wear resistant surface is electrically welded to the inner diameter of the ring to increase the useful life of the ring.

2 Claims, 3 Drawing Figures

TRUCK BOLSTER FLANGE AND WEAR RING

BACKGROUND OF THE INVENTION

Truck bolsters form a part of the under carriage of railroad cars. The truck bolsters include wear rings which must be periodically replaced.

Therefore, it is a principal object of the invention to provide a truck bolster ring having a wear resistant surface provided on the inner diameter thereof to substantially increase the life of the ring.

A still further object of the invention is to provide a truck bolster ring having a hardened alloy material electrically welded to the inner diameter thereof.

A still further object of the invention is to provide an economical means for lengthening the life of a truck bolster ring.

These and other objects will be apparent to those skilled in the art.

SUMMARY OF THE INVENTION

A truck bolster ring is described wherein a hardened alloy material is electrically welded to the inner diameter of the ring to substantially increase the useful life of the ring. Preferably, the hardened alloy is comprised of Stoody No. 131 manufactured by Stoody Company, Industry, Calif.

DESCRIPTION OF THE PREFERRED EMBODIMENT

Figure 1:
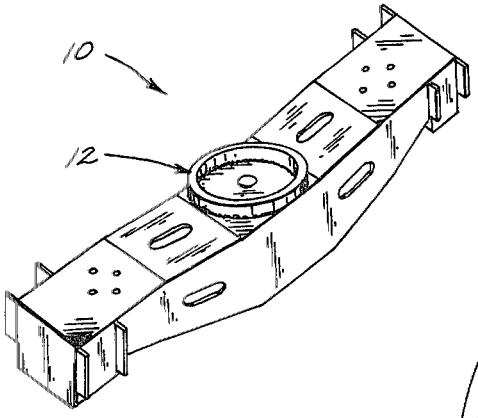
FIG. 1 is a perspective view of a truck bolster.
Figure 2:
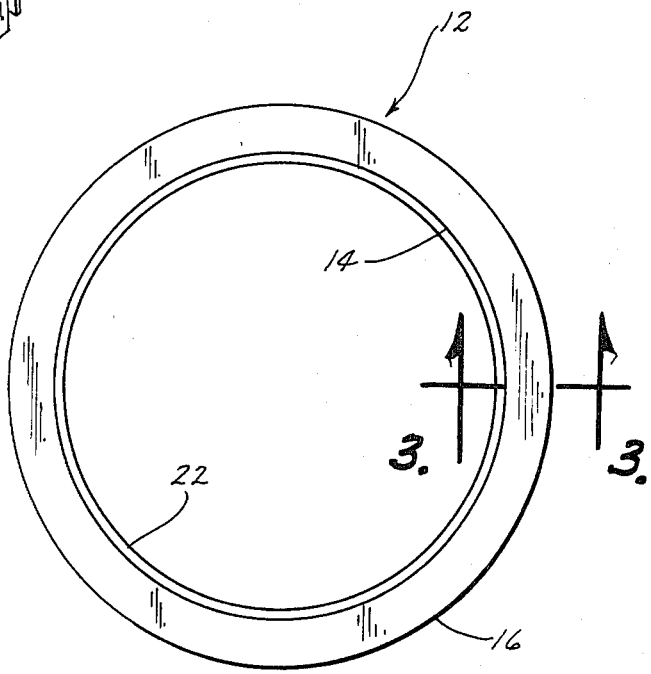
FIG. 2 is a plan view of the bolster ring of this invention.
Figure 3:
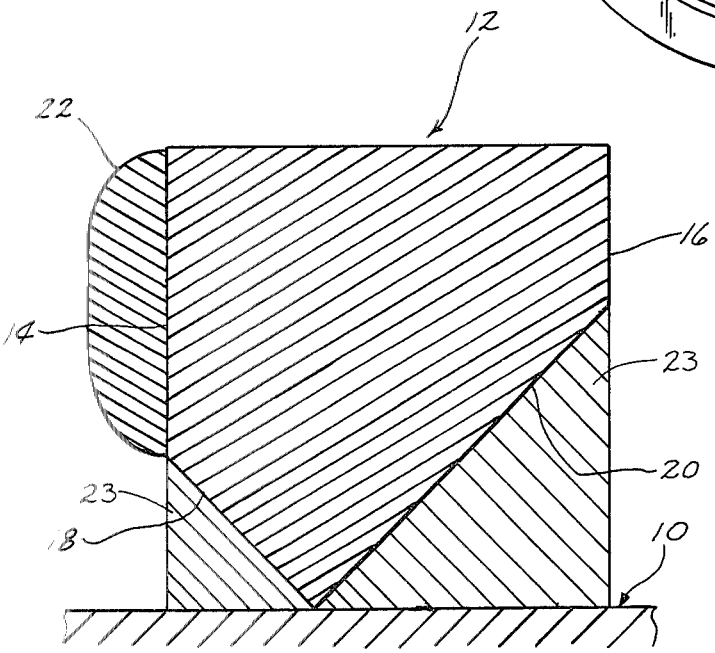
FIG. 3 is an enlarged sectional view seen on lines 3—3 of FIG. 2.

The numeral 10 illustrates a truck bolster having the bolster ring 12 mounted thereon by welding or the like to form an upstanding flange. The term "bolster ring 12", as used herein, thus refers to that element which forms the upstanding flange. The inner liner of the flange which is adapted to contact a center post is separately referred to hereinbelow as wear resistant material 22. Ring 12 is comprised of a steel material and has inner and outer diameters 14 and 16 respectively. The ring 12 is also cut away at 18 and 20 to provide the configuration illustrated in FIG. 3. The ring 12 is positioned on a bolster 10 as illustrated in FIG. 3 and the cut-away areas 18 and 20 are filled with a suitable welding material 23 to weld the ring to the bolster 10.

The heart of the invention comprises the wear resistant surface or material 22 which is electrically welded to the inner diameter 14 of the ring 12. Preferably, the surface 22 is comprised of a hardened alloy material such as sold under the trademark "STOODY No. 131" by Stoody Company, Industry, Calif. As stated, the surface 22 is electrically welded to the inner diameter 14 and has a substantially greater wear life than the ring itself. The wear resistant surface 22 greatly increases the useful life of the ring. Thus it can be seen that a novel bolster ring has been provided which accomplishes at least all of its stated objectives.

We claim:

1. In combination, a truck bolster, a bolster ring positioned on said bolster and secured thereto by a weldment to form an upstanding flange, said bolster ring having inner and outer diameter surfaces, said inner diameter surface including an upper portion and a cut-away lower portion defining a recess which is at least partially filled by said weldment, and a wear resistant material secured to said upper portion of the inner diameter surface of said bolster ring in vertically spaced relation above said truck bolster, said wear resistant material comprising an alloy weldment.

2. A bolster ring adapted to be welded to a truck bolster to form an upstanding flange thereon, comprising, said ring having inner and outer diameter surfaces, said inner diameter surface including a generally upright upper portion, a cut-away lower portion defining a recess below said upper portion for receipt of weld material and a bottom edge, and a wear resistant material secured to said upper portion of the inner diameter surface of said bolster ring in vertically spaced relation above said bottom edge, said wear resistant material comprising an alloy weldment.

* * * * *